United States Patent [19]

Cade et al.

[11] Patent Number: 4,514,135

[45] Date of Patent: Apr. 30, 1985

[54] APPARATUS FOR TRANSPORTING AND ARTICULATING AN ARTICLE

[75] Inventors: J. Weldon Cade, Orange; Stanley I. Stein, La Mirada, both of Calif.

[73] Assignee: The United States of America as represented by the Secretary of the Army, Washington, D.C.

[21] Appl. No.: 513,540

[22] Filed: Jul. 13, 1983

[51] Int. Cl.[3] ..... B66F 9/00

[52] U.S. Cl. ..... 414/682; 294/86.41; 414/782

[58] Field of Search ..... 414/682, 681, 782, 777, 414/754, 680; 294/86 LS, 67 A, 67 AB, 67 AA, 103 GG

[56] References Cited

U.S. PATENT DOCUMENTS

| | | | |
|---|---|---|---|
| 2,627,109 | 2/1953 | Bock et al. | 414/782 X |
| 2,703,252 | 3/1955 | Blackwell | 414/777 X |
| 2,882,086 | 4/1959 | Steinback | 294/86 LS |
| 3,730,326 | 5/1973 | Irving, Jr. et al. | 414/782 X |

*Primary Examiner*—Robert J. Spar

*Assistant Examiner*—Donald W. Underwood

*Attorney, Agent, or Firm*—Anthony T. Lane; Robert P. Gibson; Michael C. Sachs

[57] ABSTRACT

The present invention provides transport apparatus for transporting and articulating an article into and out of a housing having limited access, and includes a lifting beam having a curved shape to which is attached a lifting assembly. A hoist device is connected to the lifting assembly for raising and lowering the entire transport apparatus and also includes a worm-drive assembly for moving the lifting assembly relative to the lifting beam to thereby articulate an article about a first axis. In addition, one end of the lifting beam includes a rotational mechanism which is connected to a second worm-drive assembly. Operation of the second worm-drive assembly allows the article to be rotated relative to the lifting beam which allows the article to be rotated relative to a second axis. The combined operations of hoisting and movement about the two axes allows the article to be articulated in any direction for insertion or removal from a housing having limited access.

6 Claims, 4 Drawing Figures

FIG. 2
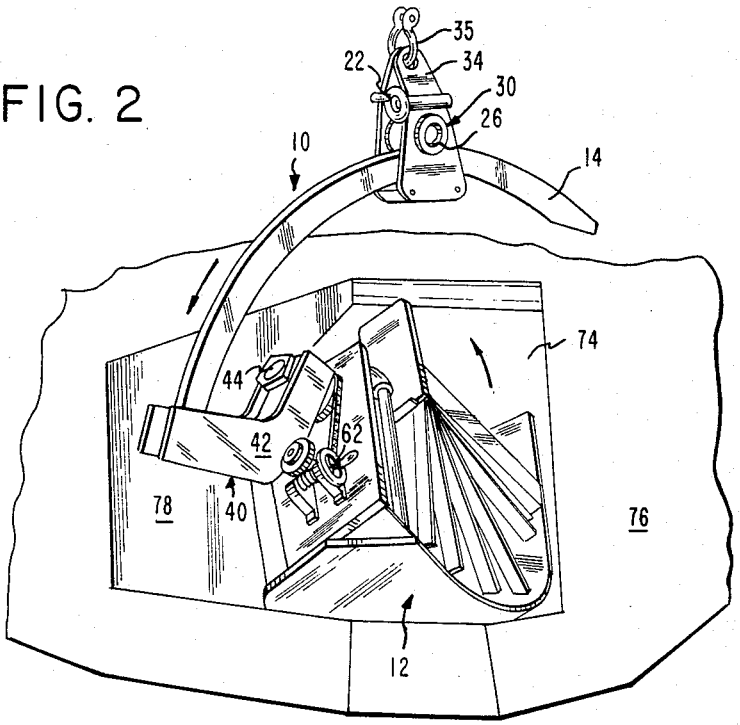
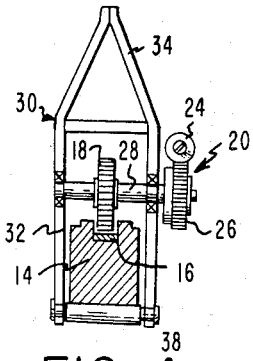
FIG. 4
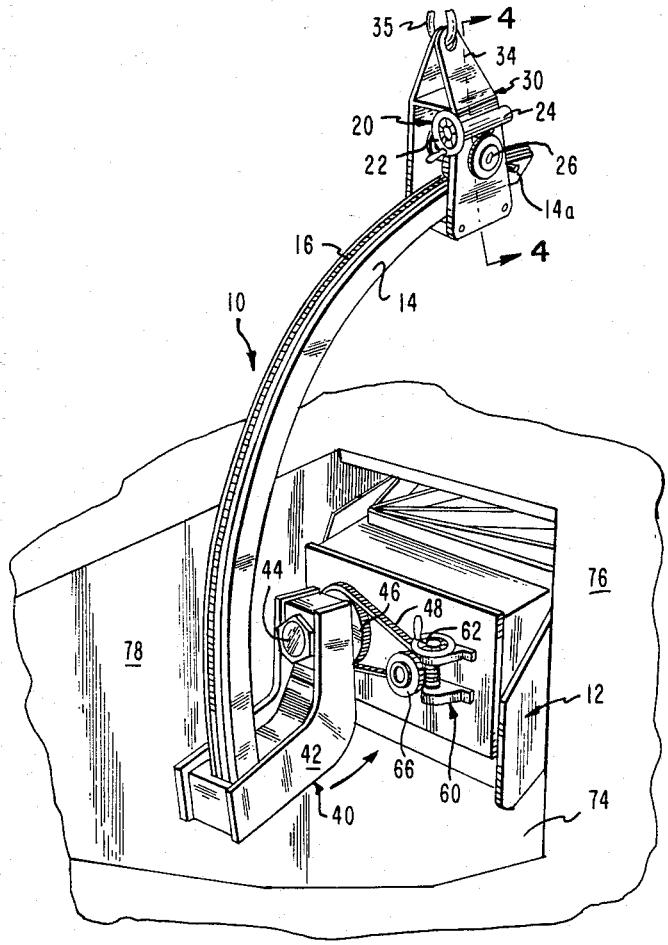
FIG. 3

APPARATUS FOR TRANSPORTING AND ARTICULATING AN ARTICLE

GOVERNMENTAL INTEREST

The invention described herein may be manufactured, used, and licensed by or for the Government for governmental purposes without the payment to us of any royalty thereon.

BACKGROUND OF THE INVENTION

The present invention relates generally to apparatus for transporting and articulating the movement of an article into and out of a housing having limited access. Advantageously, as a result of the present invention, an improved transport apparatus is provided, which is inexpensive, yet efficiently allows movement about various axes and allows complex movement in various directions to be effected in order maneuver the article into and out of a housing.

Material transport devices are well known in the prior art, and include devices for manipulating articles about various axes and for lifting them into various positions. However, there is no prior art device which is capable of lifting and articulating a heavy device into position within a housing having limited access. For example, there is no present device which has a particular application to lifting and maneuvering an ammunition fan conveyor into a turret compartment, the shape of which prohibits insertion or removal using conventional lifing equipment. The shape of the turret compartment and the configuration of the fan conveyor require that the fan conveyor be maneuvered using a combination of complex motions, as well as lift, to effect installation or removal of the fan conveyor into and out of the turret compartment. In particular, the fan conveyor or the article to be transported, requires movements about various axes, as well as lifting or lowering the article. In addition, in articulating the movement of the article, it is necessary to move the article about a first axis, then a second axis, and then about the first axis again, as well as being able to lift and lower the article after it has been moved about any particular axis. It is also necessary that the transport apparatus be capable of holding or locking the article in any particular position relative to one axis, while it is being moved about another axis or lifted or lowered. Presently-existing devices do not have the capabilities of accomplishing the foregoing.

Accordingly, it is an object of the present invention to provide an improved transport apparatus for transporting and articulating an article into and out of a housing having limited access and which has the foregoing capabilities lacking in the prior art. Specifically, it is within the contemplation of the present invention to provide an improved transport apparatus which is inexpensive, but which allows complex motions to be effected, including movement about at least two axes, as well as effecting lifting and lowering movements while the article is in any position relative to said axes.

It is a further object of the present invention to provide a transport apparatus having a configuration which directs the lift forces through the center of gravity of the article, and also allows rotation of the article around an axis which is directed through the center of gravity of the article, so that the mechanical effort required to elevate and rotate the article is minimized.

It is a still further object of the present invention to provide drive assemblies which hold or lock in any position, so that complex movements can be effected, which thereby allows the article to be maneuvered into any particular position.

SUMMARY OF THE INVENTION

Briefly, in accordance with the principles of the present invention, there is provided an improved transport apparatus for transporting and articulating an article, such as a fan conveyor, into and out of a housing having limited access, such as a turret compartment. The apparatus includes a C-shaped lifting beam having a roller chain mounted thereon. A lifting assembly is also provided which includes a bracket for connection to a hoist device and a first manual worm-drive assembly for engaging the roller chain mounted on the lifting beam for driving the lifting assembly relative to the lifting beam and to rotate the article about a first axis, defined as the X axis. In addition, the apparatus includes an L-shaped rotational mechanism connected to one end of the lifting beam and which includes a driven sprocket rotatable relative to the lifting beam. The driven sprocket is driven by a second manual worm-drive assembly including a sprocket and chain for driving the driven sprocket, so as to rotate the article relative to the lifting beam and about a second axis, which is defined as the Z axis. There is also provided an attachment plate for removably attaching the transport apparatus of the present invention to the article to be transported.

Advantageously, as a result of the present invention, the transport apparatus provides the necessary complex motion and control required to effect installation or removal of an article into a housing with limited access. In addition, the "C" configuration of the lifting beam directs the lift forces through the center of gravity of the fan, since the radius of the lifting beam is centered at the center of gravity of the article. Still further, rotation of the article is around an axis which is also directed through the center of gravity of the article. Therefore, directing such lifting and rotational forces through the center of gravity of the article minimizes the mechanical effort required to lift and rotate the article. Still further, movement of the article is accomplished through worm drives which tend to "lock" the drives in any position without the need for additional ratchet or detent mechanisms. Accordingly, one worm drive can be operated without affecting the position of the other worm drive or lift mechanism relative to the article, so that movement in any direction can be accomplished at any time during the operation of lifting, lowering, or rotating the article about various axes.

BRIEF DESCRIPTION OF THE DRAWINGS

Further objects, features, and advantages of the present invention will become apparent upon the consideration of the detailed description of the presently preferred embodiment, when taken in conjunction with the accompanying drawings, wherein:

FIG. 2 is a perspective view showing the article being partially inserted within a housing having limited access;

FIG. 3 is a perspective view illustrating the transport apparatus with the article almost completely installed within the housing; and FIG. 4 is a cross-sectional view taken on section lines 4—4 in FIG. 3.

DETAILED DESCRIPTION OF THE PREFERRED EMBODIMENT

Figure 1:
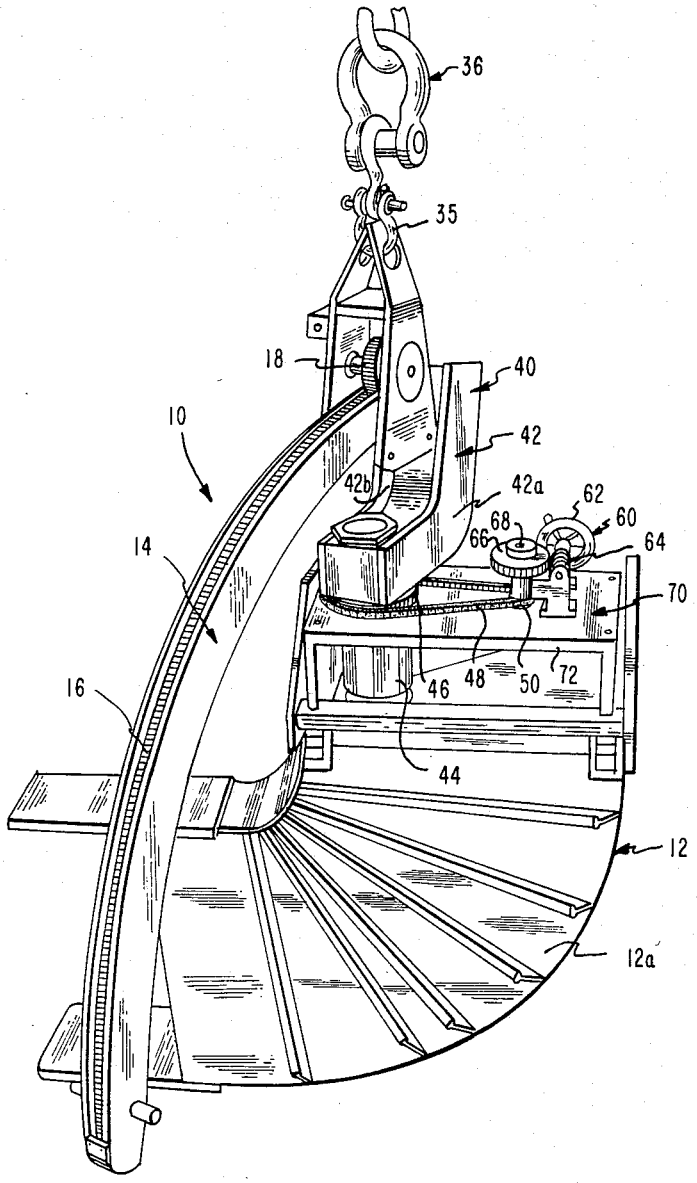
FIG. 1 is a perspective view of the transport apparatus with the article manipulated to a vertical position.

Referring now to FIG. 1, there is shown the transport apparatus embodying the principles of the present invention, generally designated by the reference numeral 10. The article, or fan conveyor, to be maneuvered is designated by the reference numeral 12. The transport apparatus 10 includes a lifting beam 14 having a semicircular or C-shaped configuration, so that lifting forces may be directed through the center of gravity of the article 12. Mounted on the lifting beam 14 is a roller chain 16 and a sprocket 18, which function similar to a rack and pinion device. That is, as shown in FIGS. 3 and 4, the sprocket 18 is driven relative to the roller chain 16 by a manual worm-drive assembly 20, which includes sprocket 18, a hand-operated wheel 22 for turning a worm 24, which in turn drives a sprocket 26 mounted on the same shaft 28 as is sprocket 18. The ends of shaft 28 are fixed to the wall 32 of a lifting assembly 30.

The lifting assembly 30 includes an upper bracket 34 to which a hoisting ring 35 may be attached for connecting a suitable hoisting device 36 to the transport apparatus 10 of the present invention. The bottom of the walls 32 are connected by rollers 38, so that lifting beam 14 can move relative to the lifting assembly 30.

In this manner, when hand wheel 22 is rotated, it causes sprockets 26 and 18 to also rotate and thereby drive lifting assembly 30 along roller chain 16, so that there is relative movement between lifting assembly 30 and lifting beam 14. In addition, as will be explained herein, as lifting assembly 30 moves relative to lifting beam 14, the article 12 is rotated about a first axis, which is defined herein as the X axis.

As shown in FIG. 2, one end of the lifting beam 14 is provided with an L-shaped rotational mechanism 40 which includes an L-shaped bracket 42 having two spaced-apart members 42*a* and 42*b*. Rotatably mounted between members 42*a* and 42*b* is a shaft 44 which, as will be explained herein, allows rotational movement between lifting beam 14 and article 12. In addition, fixedly mounted on shaft 44 is a driven sprocket 46 which is driven by chain 48 and smaller sprocket 50, which forms part of a second manual worm-drive assembly 60. Worm-drive assembly 60 includes a manual hand wheel 62 for rotating a worm 64 and driving a sprocket 66. Sprocket 66 is mounted on the same shaft 68 as is sprocket 50. In this manner, operation of hand wheel 62 causes sprockets 66 and 50 to rotate, which drives driven sprocket 46, causing shaft 44 to rotate relative to L-shaped bracket 42. As a result, operation of the hand wheel 62 causes article 12 to be rotated about an axis extending through shaft 44, which may be defined herein as the Z axis, and which extends through the center of gravity of the article 12. Also, such movement about the Z axis of the article 12 can be effected independent of the movement of the lifting beam 14 relative to the lifting assembly 30.

Referring to the drawings, it is also noted that fan conveyor or article 12 is attached to the transport apparatus 10 of the present invention by an attachment frame 70 which is bolted or connected to article or fan conveyor 12 in any suitable manner. In addition, attachment frame 70 includes a mounting plate 72 on which is mounted the second worm-drive assembly 60, as well as driven sprocket 46 and shaft 44 which does not rotate relative to attachment frame 70.

The operation of the transport apparatus 10 of the present invention may be described as follows. First, the attachment frame 70 is bolted to the article 12 which is to be moved into opening 74 of housing 76 shown in FIG. 2. In addition, housing 76 includes a wall 78 (see FIG. 3) which severely limits access of the fan conveyor 12 into the opening 74 of housing 76. When the attachment frame 70 is being attached to the article 12, the transport apparatus 10 and article 12 are in the general configuration shown in FIG. 3, with the article 12 typically lying on the ground, with its surface 12*a* (see FIG. 1) in contact with the ground.

To initiate movement, hand wheel 22 is operated to move lifting assembly 30 relative to lifting beam 14, so that the arrangement changes from that shown in FIG. 3 to that shown in FIG. 1, wherein the lifting assembly 30 is adjacent to the L-shaped rotational mechanism 40. This causes the conveyor 12 to be lifted to a substantially vertical configuration as shown in FIG. 1. In this manner, conveyor 12 has been rotated about the first axis or X axis as defined herein.

Referring now to FIG. 2, in order for the transport device 10 to lift and manipulate the conveyor 12 into opening 14, as will be noted, lifting assembly 30 is again driven by hand wheel 22 relative to lifting beam 14, and in addition, hand wheel 62 is operated so that article 12 is rotated relative to L-shaped bracket 42, so that it is moved from the configuration, as shown in FIG. 1, to the configuration shown in FIG. 2. As a result of such movements, as shown in FIG. 2, the conveyor 12 can be angled to be partially inserted within opening 74 of housing 76.

Referring now to FIG. 3, hand wheel 22 is operated so that lifting assembly 30 is again moved relative to lifting beam 14, so that it is adjacent end 14*a* of lifting beam 14. In addition, hand wheel 62 is again operated so that article 12 is rotated about the Z axis extending through shaft 44 to bring article 12 to the horizontal configuration shown in FIG. 3. At this point, the combined maneuvers are continued until conveyor 12 is in its completely-installed position within housing 76. Then, appropriate connections can be made within the housing 76 to connect the fan conveyor 12 to the turret compartment. Once article 12 is in the completely-installed position, attachment frame 70 can be unbolted and detached from article 12, and transport apparatus 10 moved out of position.

In order to remove fan conveyor 12 from housing 76, the above sequence of operation is reversed, with the above-described movements being carried out in reverse order.

As will be apparent from the foregoing description, the transport apparatus 10 of the present invention affords accurate positioning of the article 12 about two axes, referred to herein as the X and Z axes, which are required to insert the article 12 into its installed position or for removal of the article 12 from its installed position. In addition, the C configuration of lifting beam 14 directs the lift forces through the center of gravity of article 12, since the radius of C-shaped lifting beam 14 is centered at the center of gravity of article 12. In addition, rotation of article 12 is around the Z axis extending through shaft 44, which axis also extends through the center of gravity of article 12. In this manner, directing such lifting forces and rotational forces through the center of gravity of article 12 minimizes the mechanical effort required to lift and rotate article 12. Still further, elevation and rotation are accomplished through worm-drive assemblies 20 and 60 which tend to "lock" or hold the drives in any particular position, without the need for additional ratchet or detent mechanisms. In this manner, operation of one drive assembly does not affect the positioning of the other drive assembly relative to article 12, so that a combination of opertions of the worm-drive assemblies are effective to manipulate or maneuver article 12 into any position in order to efficiently insert or remove article 12 from housing 76.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. Transport apparatus for transporting and articulating an article into and out of a housing, comprising:

a lifting beam having moving means mounted thereon;

a lifting assembly including means for connection to a hoist and a first drive assembly for driving said lifting assembly relative to said moving means and said lifting beam so as to rotate said article about a first axis;

rotational means connected to one end of said lifting beam and including driven sprocket means and a shaft member rotatable relative to said lifting beam; and support means connected to said one end of said lifting beam, said support means including an L-shaped bracket through which said shaft member extends, to be rotatably connected to said support means, said driven sprocket means rotating said shaft member relative to said support means;

a second drive assembly including a sprocket and chain for driving said driven sprocket means and shaft member so as to rotate said article relative to said lifting beam and about a second axis; and removable attachment means for removably attaching said transport apparatus to said article to be transported.

2. Transport apparatus in accordance with claim 1 wherein said moving means mounted on said lifting beam is a roller chain.

3. Transport apparatus in accordance with claim 1 wherein said second drive assembly is mounted on said attachment means.

4. Transport apparatus in accordance with claim 1 wherein said first drive assembly includes a manually-driven worm drive assembly, and said first axis is said X axis.

5. Transport apparatus in accordance with claim 1 wherein said second drive assembly includes a manually-driven worm drive assembly.

6. Transport apparatus in accordance with claim 1 wherein said lifting beam is curved in shape.

* * * * *